US005562028A

United States Patent [19]

Bielfeldt et al.

[11] Patent Number: 5,562,028

[45] Date of Patent: Oct. 8, 1996

[54] LONGITUDINAL AND CONVEX FLEXURAL DEFORMATION OF A PRESS PLATE/HEATING PLATE IN A CONTINUOUSLY OPERATING PRESS

[75] Inventors: Friedrich B. Bielfeldt, Pähl; Detlef Kroll, Eppingen, both of Germany

[73] Assignee: Maschinenfabrik J. Dieffenbacher GmbH & Co., Eppingen, Germany

[21] Appl. No.: 391,675

[22] Filed: Feb. 21, 1995

[30] Foreign Application Priority Data

Feb. 19, 1994 [DE] Germany ..... 44 05 342.8

[51] Int. Cl.[6] ..... B30B 5/06

[52] U.S. Cl. ..... 100/930 RP; 100/99; 100/154; 156/583.3; 156/583.5; 425/371

[58] Field of Search ..... 100/93 P, 93 RP, 100/99, 151, 154, 211; 156/583.3, 583.5; 425/371

[56] References Cited

U.S. PATENT DOCUMENTS

| | | | |
|---|---|---|---|
| 2,071,999 | 2/1937 | Dike | 100/93 RP |
| 2,602,960 | 7/1952 | Fischbein | 425/371 |
| 3,851,685 | 12/1974 | Ahrweiler et al. | 100/154 |
| 3,965,769 | 6/1976 | Ahrweiler et al. | 100/151 |
| 3,993,426 | 11/1976 | Ahrweiler et al. | 425/371 |
| 4,101,370 | 7/1978 | Russell | 100/154 |
| 4,164,386 | 8/1979 | Stäbler | 425/371 |
| 4,468,188 | 8/1984 | Gerhardt | 425/371 |
| 4,645,632 | 2/1987 | Böttger et al. | 100/154 |
| 5,112,431 | 5/1992 | Gerhardt et al. | 156/583.5 |
| 5,253,571 | 10/1993 | Bielfeldt et al. | 100/41 |
| 5,323,696 | 6/1994 | Bielfeldt et al. | 100/154 |
| 5,333,541 | 8/1994 | Bielfeldt et al. | 100/41 |

FOREIGN PATENT DOCUMENTS

| | | | |
|---|---|---|---|
| 7525935 | 4/1980 | Germany . | |
| 3133817 | 3/1983 | Germany . | |
| 3914105 | 10/1990 | Germany . | |
| 1296437 | 3/1987 | U.S.S.R. | 425/371 |

*Primary Examiner*—Stephen F. Gerrity
*Attorney, Agent, or Firm*—Foley & Lardner

[57] ABSTRACT

A continuously operating press for production of particle boards, fiber boards or similar wood boards and plastic boards includes flexible endless steel belts which transmit pressing pressure and pull materials to be pressed through the press. The steel belts are guided via driving drums and reversing drums around an upper and a lower press beam and are supported with an adjustable press nip against upper and lower press/heating platens on the press beams via rolling supporting elements which accompany their revolution and are guided with their axes transverse to the running direction of the belt. The press ram for the press includes a plurality of individual beams, which are interconnected in an elastic and vertically adjustable manner and each individual beam has an elastically non-positive suspension of the upper press/heating platen for a longitudinal bending deformation at the press ram, and an elastically non-positive arrangement of the lower press/heating platen for a transverse bending deformation at the press ram. The press ram is regulated flexibly and hydromechanically.

14 Claims, 4 Drawing Sheets

LONGITUDINAL AND CONVEX FLEXURAL DEFORMATION OF A PRESS PLATE/HEATING PLATE IN A CONTINUOUSLY OPERATING PRESS

BACKGROUND OF THE INVENTION

The invention relates to a continuously operating press for the production of particle boards, fiber boards or similar wood boards and plastic boards.

In the continuously operating press according to German Offenlegungsschrift 40 17 791, the upper press/heating platen is vertically adjustable for the setting of the press nip and the lower press/heating platen is deformable by means of a plurality of cylinder-piston arrangements or hydraulic actuators disposed in rows longitudinal and transverse to the longitudinal axis of the press, a press ram comprising a plurality of individual beams, which are interconnected elastically and mutually adjustable vertically. By virtue of the elastic configuration of the press ram, in order to support and enable the control of the course of the steel belt during running of the continuously operating press in the entry direction to the left or right, a pressure or path profile can be briefly regulated in accordance with the adjustment strategy. This means that the press ram is transported briefly from its horizontal position into an oblique position, by means of external short-stroke pressure cylinders, and the course of the steel belt is then corrected, such that it is reset, by an adjustment of the driving and/or reversing drum axes.

In the prior art, in order to control the procedure, all continuously operating presses must accurately reproduce the process sequence, as known from the intermittent-operation press technology for the production of particle boards, MDF boards (Medium Density Fiber) or OS (Oriented Strand Boards) boards. The procedure for the pressing force influence upon the pressing stock and degasification time is essentially executed by longitudinal deformation along the pressing zone. In continuously operating presses, the spherical deformation transverse to the pressing zone is additionally necessary, i.e., at least one of the two press/heating platens must be deformable between flatness (primarily in the calibration area in the exit region of the pressing zone, i.e., the low-pressure region) and a convex geometry (primarily in the entry region of the pressing zone, in the high-pressure and in the medium-pressure region), dependent upon the board thickness of the pressing stock, the bulk density and the moisture content of the particle/fiber pressing stock, to be able to regulate the minimum possible pressing factor (the maximum possible steel-belt=production speed) where optimal physical process requirements are placed upon the pressing stock itself, such as transverse tensile strength and bending strength. It is necessary along the pressing zone, longitudinally and transversely, to be able to set different nip clearances between the upper and lower press/heating platen, so as to be precise with the following nip clearance differences: longitudinal deformation (Delta I) about 0 to 3 millimeters per meter and transverse deformation (Delta q) about 0 to 1 millimeter per meter.

According to the continuously operating presses according to German Patent Specification 31 33 817 and German Patent Specification 39 14 105, the spherical influence upon the pressing stock is effected two-dimensionally with the upper press/heating platen. The longitudinal deformation is effected by the hydraulic actuator rows in each press frame along the pressing zone. The deformation is system dependent, due to the slab having a counter-heating system, and its higher inherent stiffness. The transverse deformation is herein effected essentially by the counter-heating in the slab. The counter-heating temperatures can be set differently along the pressing zone. For example, in the front region, in order to give a stronger convex deformation, lower counter-heating temperatures are employed relative to the press/heating platen temperature. By contrast, in the exiting low-pressure region of the pressing zone, in order to obtain the necessary flatness tendency, the counter-heating temperatures are regulated higher. The convex bending deformation is additionally supported at each press frame by minimizing the hydraulic actuating forces of the outer cylinders of the actuator row. However, this is only possible to a limited degree, since the slab system possesses high inherent stiffness. By virtue of the fact that the entire system operates relatively sluggishly in terms of the adjustability in the direction transverse to the transport of the pressing stock, an on-line adjustment in an economic fashion is not possible in just a few seconds. In other words, a flying production changeover or rapid optimization of the start-up procedure, for which a continuously operating press was supposed to be designed, is either not at all possible or possible only within limits. Nevertheless, the spherical deformation along the pressing zone in the longitudinal and transverse directions can be carried out preventively at idle, prior to the pressing stock being driven into the continuously operating press.

In continuously operating presses having bottom-piston systems, as in German Offenlegungsschrift 21 57 746, German Offenlegungsschrift 25 45 366 and German Utility Model 75 25 935, the lower press/heating platen, as in the previously described top-piston system, is deformed two-dimensionally. The press/heating platen is of relatively thin and consequently very flexible construction. By means of multiple hydraulic bottom pistons, convex transverse deformations can be brought about by differently regulated force influences in these bottom pistons for each press frame. The longitudinal deformation for different compression or degasification states of the pressing stock along the pressing zone is realized by altered path positions (spindle adjustment of the servo valve). The triggering of an altered longitudinal or transverse deformation can be effected on-line and it is not carried out preventively at idle prior to feed-in of the pressing stock, since the press/heating platen is supported, lying only in non-positive engagement on the hydraulic plunger-bottom piston carpet. A further drawback is that, in this construction, the different press nip for the pressing stock between the upper and lower press/heating platen can be set only by the reactive resetting forces of the plastic pressing stock as the bending and buckling stiffness of the lower press/heating platen is simultaneously surmounted. This means that the technological production parameters for the spherical deformation cannot be exactly reproduced. Furthermore, upon each production changeover and re-start, a greater start-up wastage of the pressing stock is inevitable.

SUMMARY OF THE INVENTION

The object of the invention is to provide a continuously operating press of the stated type, by which it is possible, while avoiding the described drawbacks, to regulate or set along the pressing Bone, between the upper and lower press/heating platens longitudinally and transversely, a change in the press nip clearances, both at idle prior to feed-in of the pressing stock (start-up operation) and during load operation amidst production, and to carry out the above functions on-line in Just a few seconds by hydromechanical means.

The above objects of the invention are accomplished with a continuously operating press for production of particle boards, fiber boards or similar wood boards and plastic boards comprising:

flexible endless steel belts which transmit pressing pressure and pull materials to be pressed through the press, are guided via driving drums and reversing drums around an upper and a lower press beam and are supported with an adjustable press nip against an upper and a lower press/heating platens on the press beams via rolling supporting elements which accompany their revolution and are guided with their axes transverse to the running direction of the belt; and a press ram including a plurality of individual beams, which are interconnected in an elastic and vertically adjustable manner, each individual beam having an elastically non-positive suspension of the upper press/heating platen for a longitudinal bending deformation at the press ram, and an elastically non-positive arrangement of the lower press/heating platen for a transverse bending deformation at the press ram, wherein said press ram can be flexibly and hydromechanically regulated.

An especially advantageous feature of the invention is the elastically non-positive suspension or connection of the upper press/heating platen to the hydromechanically controllable press ram and of the lower press/heating platen to the lower, stationary press table. On the table centrally relative to the convex bending deformation transverse to the press stand or press stand construction, there are disposed one or more hydraulic short-stroke plunger cylinders. Further, for the geometric registration and control of the spherical nip clearances, there are provided in the longitudinal direction and on the outside, respectively to the left and right of the pressing zone and centrally beneath the press/heating platen, path sensors of a measuring and control device having path sensors. The non-positive connections are elastic (spring-elastic or servo-hydraulic) and pretensioned, such that the upper and lower press/heating platens can be respectively supported, in a flexibly sliding manner, against the mechanical bearing surfaces on the webs of press ram and press table or the lower plunger pistons, while the spherical, i.e. geometrically regulated, deformation state continues to be elastically clamped in the longitudinal and transverse directions. Using the preferred and advantageous measuring and control device, a controlled regulation of a convex, concave and spherical bending deformation of the press/heating platens can be regulated in just a few seconds, irrespective of the pressing stock counter-force, while the maximum press force profile and the physical quality values for the pressing stock are maintained. Moreover, the above process can be effected on-line, and in a constantly reproducible manner, even during conversion to other board thicknesses and/or bulk densities in the start-up and production operations. Using the path-measuring system according to the invention, it is further possible along the whole of the pressing zone, in a complex process control, e.g. where the moisture content or bulk density profile is altered with regard to the respective board thicknesses and necessary transverse tensile strength, to alter the process parameters in a technologically optimal manner, in the course of a real-time adjustment, through the use of the hydraulic actuators in conjunction with the path-measuring system assigned to these actuators.

Another advantage is that, as a result of the path-sensory registration of the correct geometric alteration using the path-measuring system according to the invention, the spherical change in the pressing zone longitudinally and transversely can not only be accurately represented on the display screen, but, in accordance with the technological requirements, these path-measurement values are input into the computer system as an actual value, and compared with the desired value such that the actuators receives a corrective control pulse, thereby enabling a process control to be carried out in real-time adjustment.

Also contributing towards a fault-free determination of the measurement value of the press nip clearances or of the existing deformation of the press/heating platen in the middle is the fact that the path-measuring system is disposed outside the press such that the measurement values are transmitted outside the critical heat influence, and as a result of the lever transmission in the ratio of 1:2 to 1:4, an optimal, enlarged metrological resolution of the actual value is obtained. In one preferred embodiment, the press includes a control circuit and an automatic control system.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate the preferred exemplary embodiments of the invention, and, together with the general description given above and the detailed description of the preferred embodiments given below, serve to explain the principles of the invention, in which.

DETAILED DESCRIPTION OF THE PREFERRED EMBODIMENTS

Figure 1:
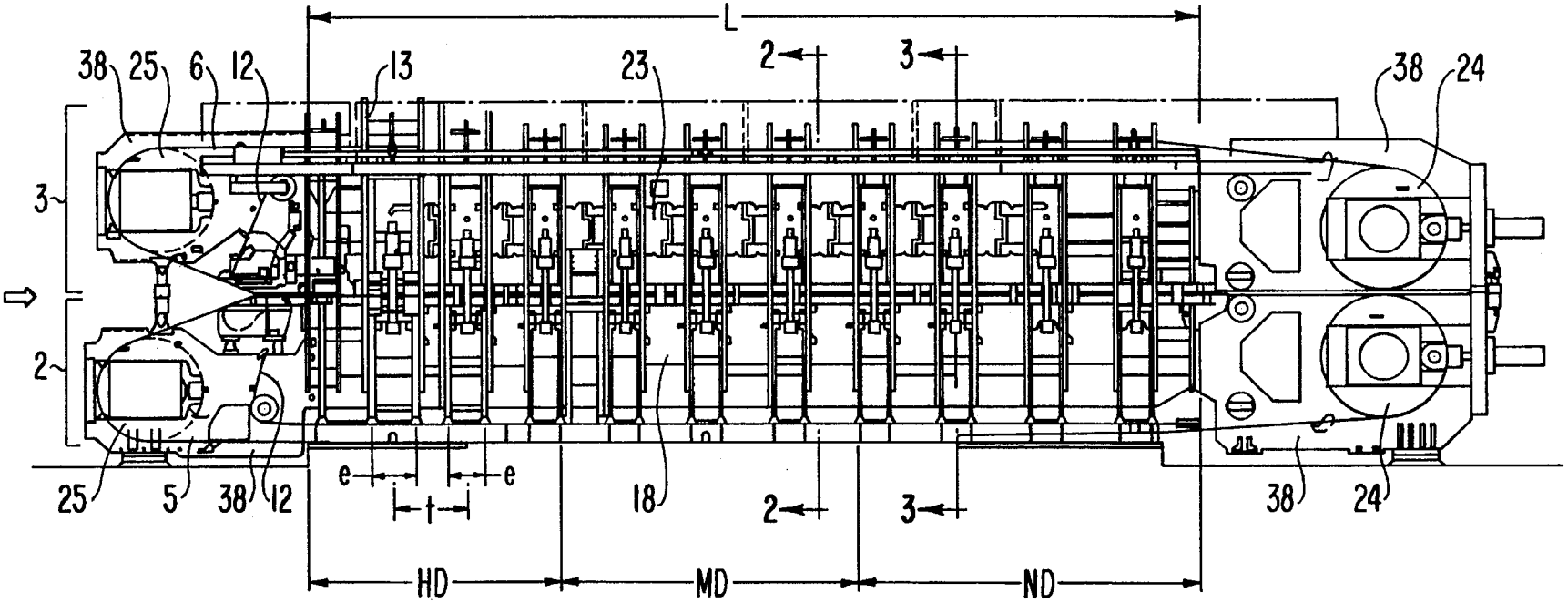
FIG. 1 shows a side view of a continuously operating press according to the invention.

The continuously operating press 1 according to the invention comprises according to FIGS. 1 to 4, in its principal parts, upper and lower press beams 3 and 2 and tiebars 13 which positively connect them. The tiebars 13 can be quickly released by means of push-in pins 33. To the end faces of the press beams 2 and 3 there are fitted side plates 38, serving as an anchorage and bearing point for driving drums 24, reversing drums 25 and entry systems for rolling rods 12. The press beams 2 and 3 comprise lower and upper web plates 15 and 16 and ribs 31 which connect these. The upper web plates 16 are connected by means of tie rods 37 to form an individual beam 23 (press ram module), and the tie rods 37 represent, by virtue of lining-up and fitting of the press/heating platens 14, the length L of the movable press beam 3. Similarly, the lower press beam 2 comprises a plurality of stationary individual beams 18 (table module).

The protrusions or projections jutting from the web plates 16 on the left and right act as counter-bearings for raising and lowering of the press ram 3, and short-stroke press cylinder-piston arrangements 7 and 8 are disposed between the upper crossheads and the protrusions of the press ram 3.

Figure 4:
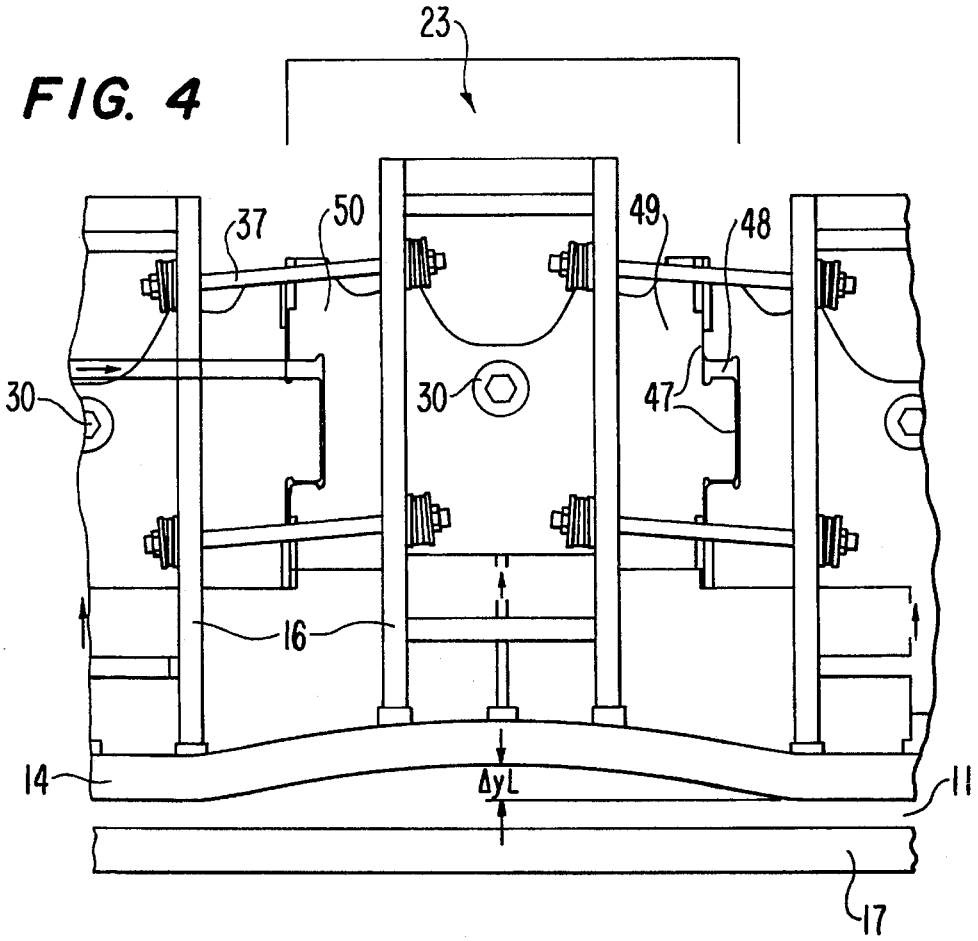
FIG. 4 shows a side view of a the connection and arrangement of two press ram modules.

FIG. 4 shows the elastic region of the press ram 3, which, in systems having a particularly high pressing pressure, can also embrace the whole of the medium-pressure region MP. A prerequisite for an elastic press ram 3, however, is the elastic interconnection of the individual beams in order to ensure the possibility of introducing an asymmetrical pressure profile in the high-pressure region HP and, where appropriate, also in the medium-pressure region MP. The individual beams 23 are connected to pull rods 37 and produce a positive engagement with the sliding surfaces 47. To enable the two individual beams 23 to be mutually adjusted by hydraulic means, distancers 49 and 50, which have a play 48, are provided. The distancer 50 is herein connected positively to the left and the distancer 49 to the right individual beam The play 48 respectively is about 0 to 1.5 millimeters up to a maximum of 3 millimeters. This motion permits elastic deformation of the pull rods 37 within a tolerable stress and also, serves as a pressure-relief for steel belts 5 and 6, so as to allow their displacement without giving rise to one-sided overstretching, and to regulate a different compression or degasification zone, by a value of Delta yL, longitudinal to the pressing zone for the pressing stock 4.

From FIG. 1 it can be further seen how the reversing drums 25 form the entry nip and how the rolling rods 12, which are guided with the steel belts 5 and 6 around the press beams 2 and 3, are supported against the press/heating platens 14 and 17, i.e. the rolling rods 12 are disposed, such that they roll along, between the press/heating platens 14 and 17 and the steel belts 5 and 6, respectively. The pressing stock 4 is pulled, with the steel belts 5 and 6 driven by the driving drums 24, through the press nip 11 and pressed into boards. The hydraulic cylinder-piston arrangements 7 and 8 are disposed with pressure pistons beneath the press/heating platen 17 and are supported on supporting plates 21 of the lower press beam 2. In the case of a bottom-piston press, they could be employed below the upper press beam 3 for the upper press/heating platen 14, while the press nip adjustment is effected by means of a movable lower press table 2. To allow the servo-hydraulics to be used to control the position longitudinally in relation to the pressing zone between the upper and lower press/heating platen 14 and 17, the return-cylinder arrangements 20, shown in FIG. 3 are necessary.

Figure 2:
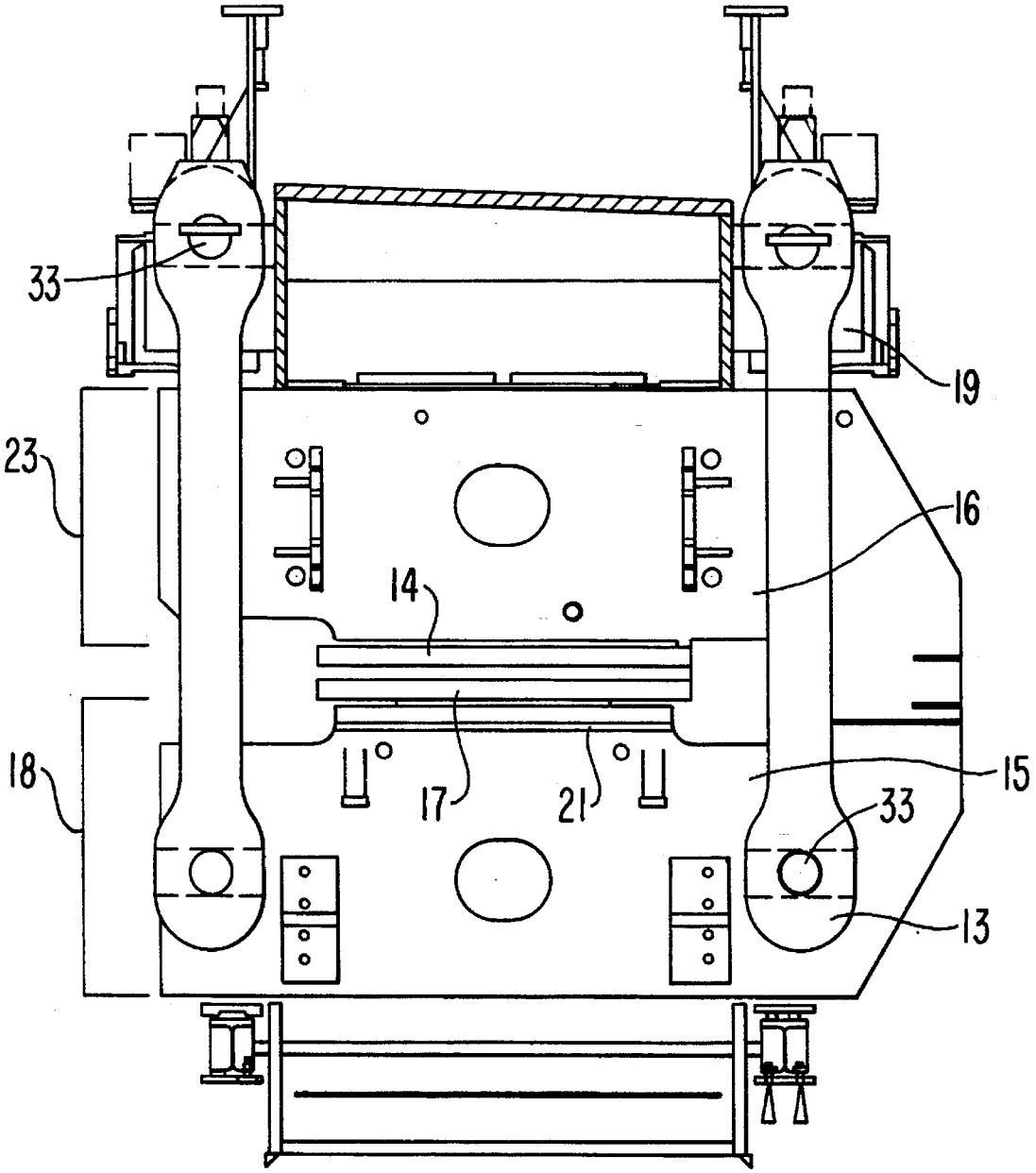
FIG. 2 shows a front view of the continuously operating press according to FIG. 1, section 2—2.
Figure 3:
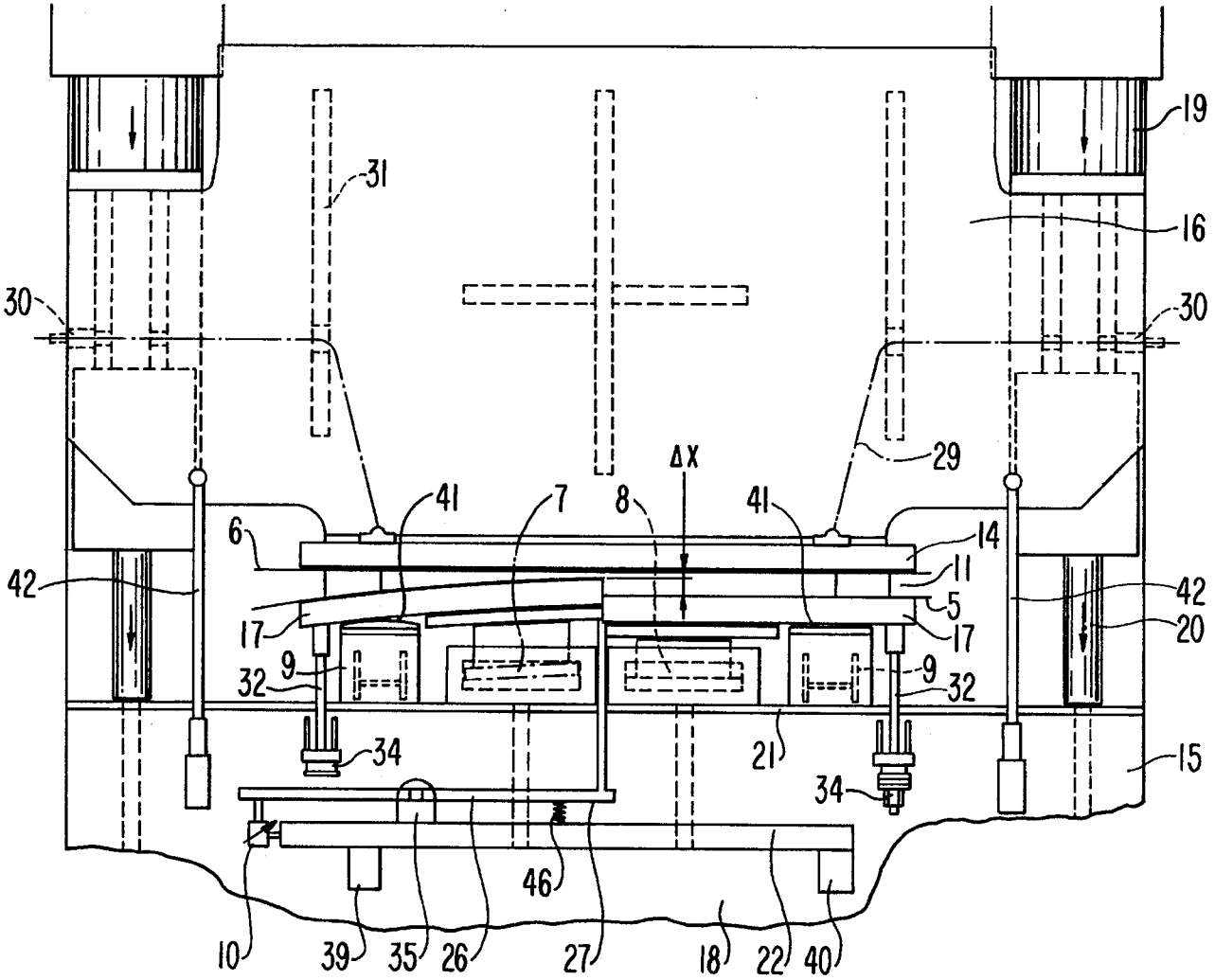
FIG. 3 shows a front view of the continuously operating press according to FIG. 1, section 3—3, exhibiting an elastically non-positive arrangement of the press/heating platen.

FIGS. 2, 3 and 4 illustrate the resiliently elastic and/or servo-hydraulic suspension of the press/heating platens 14 and 17. The upper press/heating platen 14 is connected non-positively via a Bowden cable 29 to a respective vertically displaceable press ram module 23. The Bowden cable 29 is coupled with a clamping element 30. The clamping element 30 comprises either a pretensioned spring assembly or a hydraulic, pretensioned short-stroke cylinder. The clamping element 30 and Bowden cable 29 are preferably disposed towards the outside in order to allow more maintenance-friendly access from the side (left and right). The pretensioning force in the clamping element 30 is preferably of such a magnitude that the upper press/heating platen 14 follows the respective stroke Delta y of the press ram module 23, i.e. towards the supporting plates 16. The different vertical path position of Delta y between 0 and a maximum of 3 millimeters between each press ram module 23 is regulated by the hydraulic actuators 19 and 20 and is registered in a path-sensory manner, preferably for each press ram module 23, by the lateral outer path sensors 42.

The lower press/heating platen 17, for the bending deformation transverse to the pressing zone between flatness and convex setting, is clamped elastically between the centrally disposed plunger-short-stroke cylinders 7 and 8, which perform an active hydraulic stroke, and two outer, passively acting, elastically pretensioned hold-down traction elements 32. These are in turn connected to clamping elements 34, which are connected mechanically to the stationary table modules 18. The passively acting clamping forces are supported against inner supporting brackets 9. The upper supporting surface 41 is cambered in accordance with different radii of curvature. The pretensioning force (in the spring assembly or hydraulic pressure in the short-stroke cylinder) in the clamping element 34 is of a magnitude such that, upon the active hydraulic stroke of the plunger-short-stroke cylinders 7 and 8 (stroke approximately 3 millimeters), the lower press/heating platen 17 remains constantly pressed against the cambered supporting surfaces 41. The respective convex position Delta x from flat to a maximum 3 millimeters is registered in a path-sensory manner, preferably for each table/press ram module 23, and measured in the middle, by means of a sensing rod 27 beneath the press/heating platen 14.

The hydraulic cylinder-piston arrangements are referred to in simplified form as actuators 7 and 8. Each row of actuators m is equipped with a path-sensor system according to FIGS. 3 and 5. Depending upon the width of the press, in order to change the geometric position of the lower press/heating platens 17 (convex, concave, flat), at least one, and in the case of larger widths, two or more actuators 7 and 8 are used. According to FIGS. 3 and 5, a spherical deformation of the lower press/heating platen 17 is intended to be regulated by means of these hydraulic actuators 7 and 8, the supporting brackets 9 and their passive elastic clamping by means of the hold-down traction elements 29 and clamping element 34. In order to prevent the time-consuming, experimental optimization of the individual hydraulic actuators 7 and 8 as in the prior art, the spherical deformation in both the longitudinal and transverse direction for each row of actuators m is registered in a path-sensory manner according to FIGS. 3 and 5.

Figure 5:
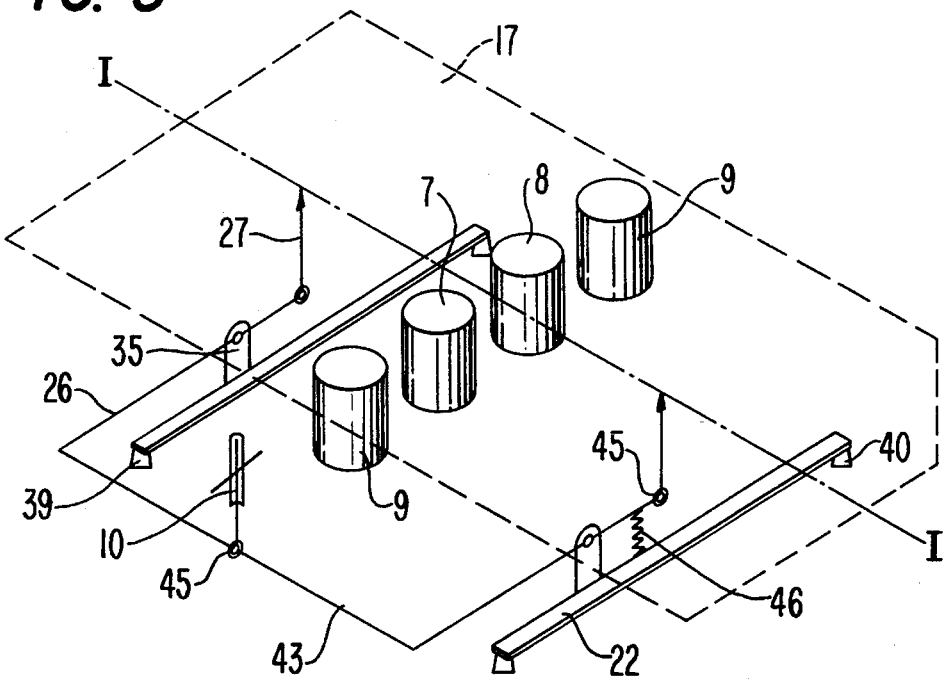
FIG. 5 shows a diagrammatic representation of a path-measuring system for the lower press/heating platen.

As a matter of principle, all path sensors 10 and 42 are disposed outside a critical temperature influence. The press nip setting 11 is registered, according to FIG. 3, on an analog or digital basis as an absolute value, by lateral path sensors 42, in terms of the change in the upper and lower press/heating platens 14 and 17 relative to each other for the pressing zone. Beneath the path-sensor systems, to the left and right of the press/heating platens 14 and 17, there is disposed perpendicularly beneath these measuring points a reference-measuring staff 22. The mechanical reference-measuring staff 22 is suspended by means of hinge-joints 45 outside critical temperature influences and a fulcrum 35 for the reception of a lever arm 26, disposed with a sensing rod 27 centrally beneath the lower press/heating platen 17 is located thereon. The sensing rod 27, supported non-positively, via hinge-joints 45, by its own weight or by spring force 46, is forced against the bottom edge of the press/heating platen 17. The path-measuring system according to FIGS. 3 and 5 is disposed, respectively with two reference-measuring staffs 22 on the two sides of the actuator rows m, at two support or suspension points 39 and 40. Two sensing rods 27, which respectively act, via a hinge-joint 45, upon a lever arm 26, are connected by a connecting rod 43, likewise in articulated fashion, to the measurement-value transmitter 45, which, outside the press region, influences the path sensor 10. The concave or convex deformation of the lower press/heating platen 17 in the range between 0 and about 3 millimeters, due to the lever transmission in the ratio 1:2 to 1:4, is transmitted to the path-measuring system disposed outside the press. This system is disposed fully beyond a critical heat influence outside the continuous press 1, such that it is easily accessible from the side. As a result of the lever transmission, a very good metrological resolution is effected. As a result of the passive, elastic, braced suspension of the upper and lower press/heating platens 14 and 17, the spherical deformation longitudinally and transversely of the entire pressing zone can be adjusted preventively at idle, at the press/heating platens 14 and 17, by hydromechanical means using the hydraulic actuators 7, 8, 19 and 20. The geometrical shape of the press nip clearances 11 which is in each case technologically necessary is registered on-line, both at idle and during load operation (production operation), longitudinally and transversely in a path-sensory manner and is permanently controlled in seconds in accordance with the hydraulic adjustment speed.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A continuously operating press for production of pressed boards comprising:

flexible endless steel belts;

driving drums and reversing drums;

an upper press beam and a lower press beam;

an upper press/heating platen and a lower press/heating platen;

rolling supporting elements each having a longitudinal axis;

wherein the flexible endless steel belts transmit pressing pressure and pull material to be pressed through the press, are guided via the driving drums and reversing drums around the upper and lower press beams and are supported with an adjustable press nip against the upper and lower press/heating platens on the press beams via the rolling supporting elements which accompany their revolution and are guided with their longitudinal axes transverse to the running direction of a belt; and a press ram including a plurality of individual beams, which are elastically and vertically adjustably interconnected, each individual beam having an elastically non-positive suspension of the upper press/heating platen for a longitudinal bending deformation at the press ram, and an elastically non-positive arrangement of the lower press/heating platen for a transverse bending deformation at the press ram, wherein said press ram can be flexibly and hydromechanically regulated.

2. The continuously operating press as claimed in claim 1, further comprising a plurality of short-stroke plunger-cylinders disposed under said lower press/heating platen for said transverse deformation of said press/heating platen.

3. The continuously operating press as claimed in claim 2, further comprising a measuring and control device including a path-sensor system having a sensing rod for sensing an actual value of the press nip, a reference-measuring staff, a lever linkage, and a measurement-value transmitter, wherein the sensing rod, reference-measuring staff, and measurement-value transmitter are operatively connected to the lever linkage, said path-sensor system being disposed outside a critical heat influence, said sensing rod being disposed in contact with said lower press/heating platen.

4. The continuously operating press as claimed in claim 3, wherein the actual value of the press nip is transmitted by the path-sensor system at a transmission ratio of 1:2 to 1:4, said transmission ratio increasing the measurement value.

5. The continuously operating press as claimed in claim 4, wherein the reference-measuring staff includes two supporting/suspension points which are disposed near outer edges of the press/heating platen.

6. The continuously operating press as claimed in claim 5, wherein a fulcrum for the reception of a lever arm for transmitting the measurement value at the transmission ratio 1:2 to 1:4 is disposed on the reference-measuring staff.

7. The continuously operating press as claimed in claim 1, wherein the upper press/heating platen is connected non-positively by Bowden cables and clamping elements to the press ram.

8. The continuously operating press as claimed in claim 7, wherein the Bowden cables are extended to a side of the individual beams of the press ram and are disposed there in coupled arrangement with the clamping elements.

9. The continuously operating press as claimed in claim 8, wherein the clamping elements have a pretensioning force sufficiently large such that said force causes a bending deformation of the upper press/heating platens.

10. The continuously operating press as claimed in claim 1, further comprising clamping elements which clamp, to a lower web plate, the lower press/heating platen elastically between a flatness and a convex setting by a plurality of centrally disposed, actively working short-stroke plunger-cylinder arrangements and, on two outer longitudinal sides, by passively working, elastically pretensioned hold-down traction elements for a bending deformation transverse to a pressing zone.

11. The continuously operating press as claimed in claim 10, wherein the clamping elements comprise either one of a pretensioned spring assembly and a hydraulically pretensioned short-stroke cylinders.

12. The continuously operating press as claimed in claim 11, wherein the hold-down traction elements are connected via clamping elements to a respective individual beam of the press ram.

13. The continuously operating press as claimed in claim 12, wherein the lower press/heating platen is supported on the two outer longitudinal sides by supporting brackets configured with cambered surfaces.

14. The continuously operating press as claimed in claim 13, wherein the clamping elements have a pretensioning force such that an active stroke of the short-stroke plunger cylinders causes the lower press/heating platen to be forced constantly against the cambered surfaces of the supporting brackets.

* * * * *